US007238898B1

(12) United States Patent
Czarnecki

(10) Patent No.: US 7,238,898 B1
(45) Date of Patent: Jul. 3, 2007

(54) SWITCH ASSEMBLY FOR AN ELECTRICAL PANEL

(75) Inventor: Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 11/360,541

(22) Filed: Feb. 23, 2006

(51) Int. Cl.
*H01H 9/20* (2006.01)

(52) U.S. Cl. ..... 200/50.32; 200/50.01; 200/26

(58) Field of Classification Search .. 200/50.32–50.37, 200/50.04, 18, 50.26, 5 R, 5 B, 5 C
See application file for complete search history.

(56) References Cited

U.S. PATENT DOCUMENTS 3,676,625 A * 7/1972 Blatt ..... 200/542
3,705,280 A * 12/1972 Harms ..... 200/50.33
3,778,633 A * 12/1973 DeVisser et al. ..... 200/50.35
4,510,357 A * 4/1985 Winterbottom ..... 200/50.33
6,541,719 B1 * 4/2003 Powell ..... 200/50.32
6,621,689 B1 * 9/2003 Flegel ..... 200/50.32
7,126,068 B2 * 10/2006 Fillppenko ..... 200/50.33

* cited by examiner

*Primary Examiner*—Elvin Enad
*Assistant Examiner*—M. Fishman
(74) *Attorney, Agent, or Firm*—Boyle, Fredrickson, Newholm, Stein & Gratz, S.C.

(57) ABSTRACT

A switch assembly for an electrical panel configured to receive electrical power from either a first power supply or a second power supply. The switch assembly includes a transfer switch operable to electrically connect the panel to receive electrical power from the second power supply when power is interrupted from first power supply. An indicator light at the panel illuminates so as indicate that electrical power from the first electrical power supply is restored while the transfer switch is positioned to receive electrical power from the second electrical power supply. A light switch is connected to selectively interrupt illumination of the indicator light. An interlock member interconnects the light switch and the transfer switch so that movement of the interlock member to connect the electrical panel to receive electrical power from the first power supply simultaneously moves the light switch so as to interrupt illumination of the indicator light.

15 Claims, 2 Drawing Sheets

SWITCH ASSEMBLY FOR AN ELECTRICAL PANEL

FIELD OF THE INVENTION

This invention relates to an assembly for and a method of switching an electrical panel to receive electrical power from one of a first power supply and a second power supply, and more specifically, to an interlock assembly configured to simultaneously switch electrical connection from the second power supply to a restored first power supply and interrupt illumination of an indicator light indicative that electrical power of the first power supply is restored.

BACKGROUND OF THE INVENTION

In today's electrical supply systems, there are occasions when alternate sources of electrical power are necessary or desirable. For example, the capability of switching from utility power to emergency generator power is extremely important for many businesses, hospitals and industries, as well as residential dwellings.

In certain applications, it is desirable for separate electrical circuits, or separate groups of electrical circuits, to be arranged so that when one circuit or group of circuits is switched to a conductive state, another circuit or group of circuits is switched to a non-conductive state in an alternating fashion. In one arrangement, it may be desirable to alternately switch a common load between separate power sources.

A certain known electrical load center includes an electrical panel with a transfer-type switch that selectively controls the supply of electrical power from one of a standard utility 125/250 VAC service and a generator power supply, respectively. In an instance when electrical power from the utility service is interrupted, the transfer switch can be moved so as to disconnect the electrical panel from the utility and to electrically connect the electrical panel to receive electrical power from the generator.

SUMMARY OF THE INVENTION

It is an object of the present invention to provide an interlock assembly that can be readily installed in an electrical panel. It is another object of the present invention to provide a switch assembly configured to selectively control a supply of electrical power from one of a utility service and a generator power supply. It is another object of the invention to provide a switch assembly to control illumination of an indicator light associated with indication of restoration of a supply of electrical power from a utility service. It is a further object of the invention to simultaneously switch from a generator power supply to a restored utility service and to interrupt illumination of the indicator light indicative of restored electrical power from the utility service.

In accordance with one aspect, the present invention provides a switch assembly for an electrical panel so as to selectively receive electrical power from one of a first power supply and a second power supply. The switch assembly includes a transfer switch mounted on the electrical panel and operable to electrically connect the electrical panel to receive electrical power from one of the first and second power supplies. When electrical power is interrupted from the first power supply, movement of the transfer switch electrically connects the panel to receive electrical power from the second power supply. An indicator light mounted on the electrical panel is electrically connected to illuminate only with electrical power from the first electrical power supply. A light switch is mounted on the electrical panel and is operable to selectively interrupt electrical connection of the indicator light to the first power supply. An interlock member mechanically interconnects the light switch to the transfer switch. The interlock member is configured such that movement of the transfer switch to electrically connect the electrical panel to receive electrical power from the first power supply also simultaneously moves the light switch to a position that interrupts electrical connection of the indicator light to the first power supply, which interrupts illumination of the indicator light.

The present invention also provides an electrical panel operable to receive electrical power from a first power supply and a second power supply. The electrical panel comprises a transfer switch having a transfer switch handle and operable to selectively connect the electrical panel to receive electrical power from one of a first power supply and a second power supply. An indicator light mounted on the electrical panel is electrically connected to illuminate only with electrical power from the first power supply. A light switch having a light switch handle is electrically connected to selectively interrupt electrical connection of the indicator light to the first power supply. An interlock handle mechanically interconnects the light switch handle to the transfer switch handle. When the indicator light is illuminated, movement of interlock handle to cause electrical connection of the electrical panel to receive electrical power from the first power supply also simultaneously causes movement of the light switch handle to interrupt electrical connection of the indicator light to the first power supply, which interrupts illumination of the indicator light.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
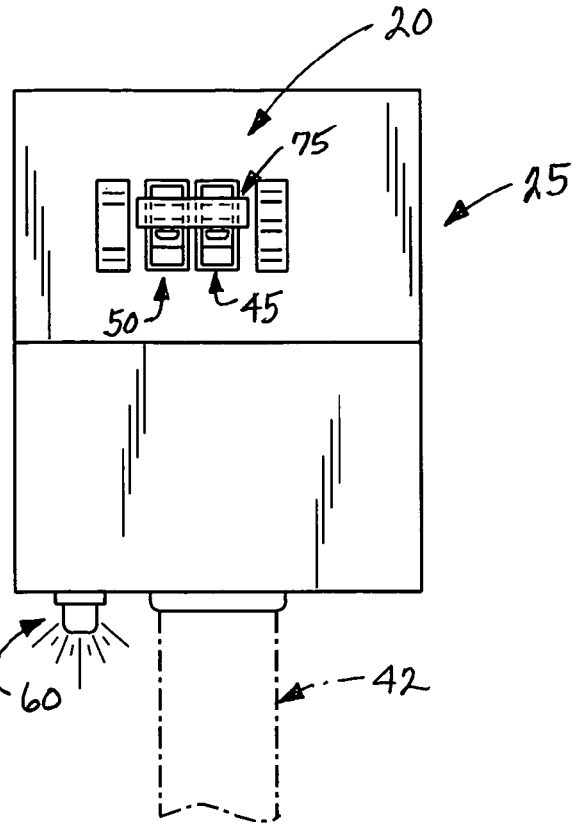
FIG. 1 is a front view of a switch assembly in accordance with the present invention mounted on an electrical control panel.
Figure 3:
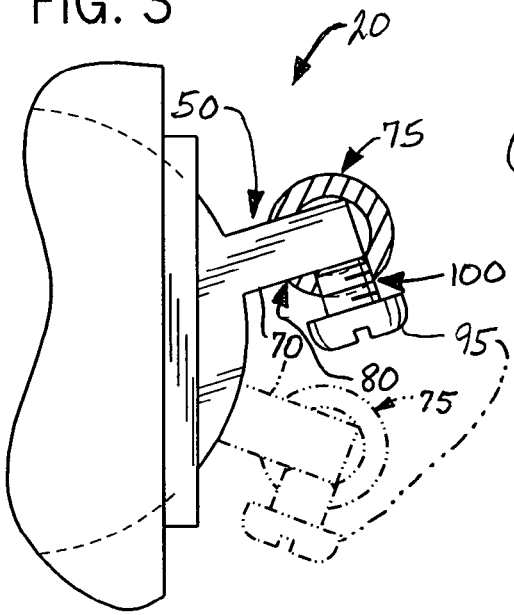
FIG. 3 is a partial cross-section view of the switch assembly along line 3—3 of FIG. 2.
Figure 2:
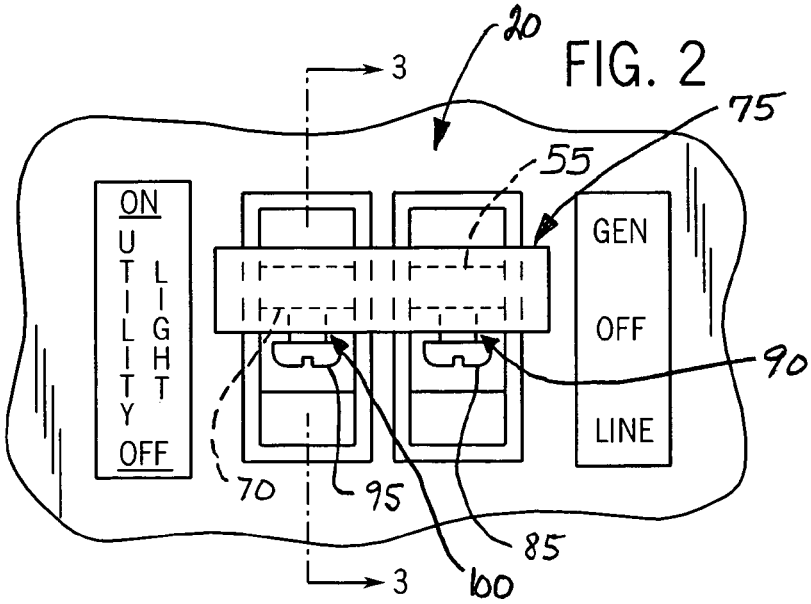
FIG. 2 is a detailed front view of the switch assembly illustrated in FIG. 1.
Figure 4:
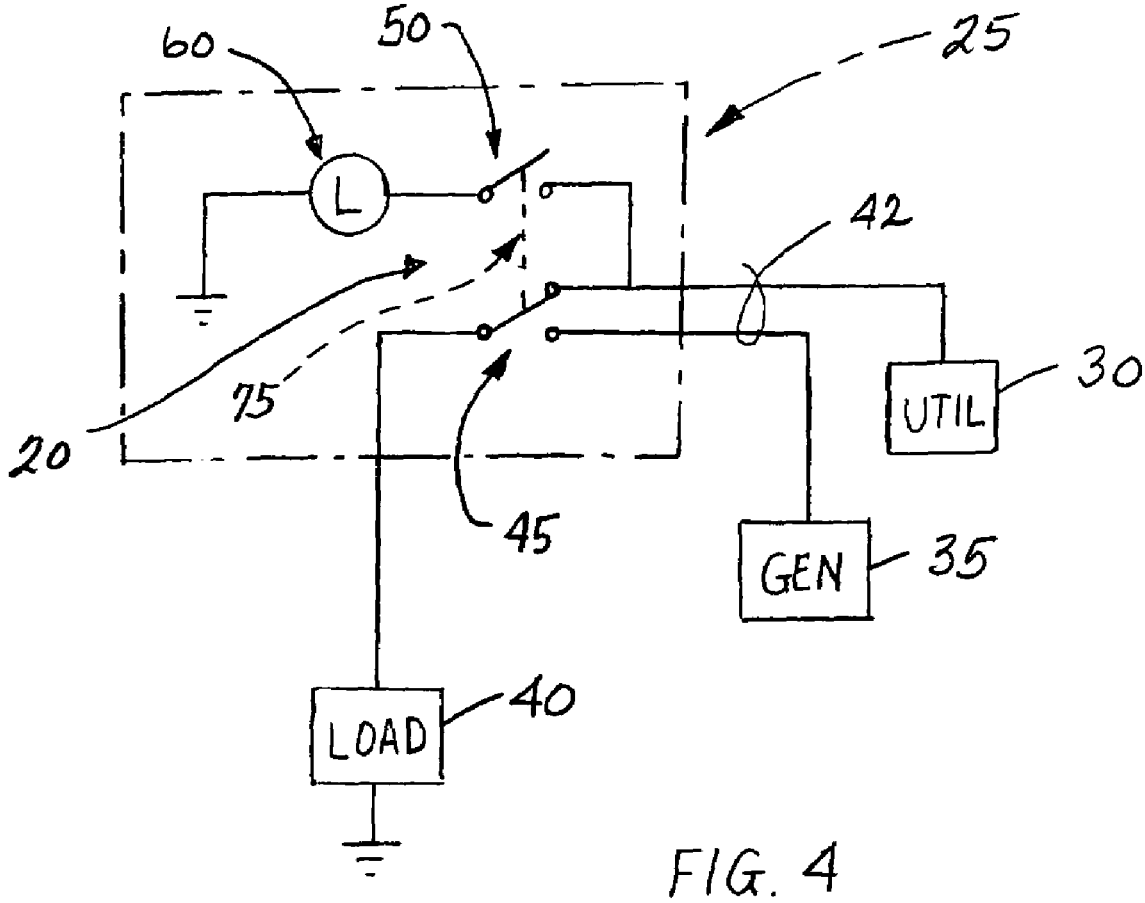
FIG. 4 is a general circuit diagram of the electrical panel shown in FIG. 1 electrically connected to receive electrical power from one of two power sources, e.g. from either utility service or a generator.

FIG. 1 illustrates a preferred embodiment of a switch assembly 20 in accordance with the present invention. The switch assembly 20 is mounted at a conventional load center or electrical panel 25. As shown in FIG. 4, switch assembly 20 is generally configured to switch the supply of electrical power to electrical panel 25 between a utility service 30 and a generator 35, for supplying power to an electrical load 40.

Although FIG. 1 illustrates a feed 42 from the utility service 30 and the generator 35 being located underneath the panel 25, it should be understood to those skilled in the art that the feed of electrical power from the utility service 30 and the generator 35 can be located on any side of, or in any location on, the electrical panel 25.

Still referring to FIGS. 1 and 4, the switch assembly 20 includes a transfer switch 45 tandemly aligned in a horizontal plane with a light switch 50. The transfer switch 45 generally includes a single-pole, double-throw switch operable to selectively make or interrupt the supply of electrical power from one of the utility service 30 and the generator 35 to the electrical panel 25. The single pole, double-throw transfer switch 45 generally includes electrical contacts (not shown) configured in a conventional manner to be electrically connected to the utility service 30 (see FIG. 4). The exemplary transfer switch 45 also includes a handle 55 configured to position the transfer switch 45 between a first position which electrically connects the electrical panel 25 to receive electrical power from the utility service 30, a second or OFF position that interrupts electrical power from both the utility service 30 and the generator 35, and a third position which electrically connects the electrical panel 25 to receive electrical power from the generator 35. Representatively, the transfer switch 45 may be a switch such as is available from Reliance Controls Corporation of Racine, Wis., under its model number 7801, although it is understood that any other satisfactory switch may be employed.

Still referring to FIGS. 1 and 4, the light switch 50 is configured to control the supply of electrical power to illuminate an indicator light 60 mounted on the electrical panel 25. The light switch 50 includes a single-pole switch operable to selectively make or interrupt electrical connection of the indicator light 60 to the utility service (See FIG. 4). The exemplary light switch 50 also includes a handle 70 for placing the light switch 50 in either the ON or OFF condition, in a manner as is known. With the light switch 50 in the ON condition, the indicator light 60 is electrically connected to illuminate only from receipt of electrical power from the utility service 30. The light switch 50 in the OFF condition interrupts electrical connection of the indicator light 60 to the utility service 30. The type (e.g., bulb, LED, etc.) of indicator light 60 can vary.

The tandemly aligned switch handles 55 and 70 of switches 45 and 50, respectively, are interconnected for movement together via an interlock member 75. The exemplary interlock member 75 is an elongated tube or channel structure having a channel 80 extending along its length. The channel 80 is open in a direction facing the ends of the switch handles 55 and 70, and is aligned to receive both switch handles 55 and 70. A first fastener 85 is received through a first opening 90 at the interlock member 75 so as to couple the interlock member 75 to the transfer switch handle 55. In a similar manner, a second fastener 95 is received through a second opening 100 at the interlock member 75 so as to couple the interlock member 75 to the light switch handle 70.

Once fastened to switch handles 55 and 70 in this manner, the interlock member 75 ties together the switch handles 55 and 70 of the transfer switch 45 and the light switch 50, respectively, to ensure that the light switch 50 is moved to the ON position at the same time when the transfer switch 45 is moved to electrically connect the electrical panel 25 to receive electrical power from the generator 35. This condition is applicable during a power loss or outage event that interrupts electrical power from the utility service 30. During such a power loss event at the utility service 30, an operator moves the interlock member 75 so as to cause the transfer switch 45 to interrupt electrical connection to the utility service 30. Continued movement of the interlock member 75 causes the transfer switch 45 to electrically connect the electrical panel 25 to receive electrical power from the generator 35. Movement of the interlock member 75 also ensures that the light switch handle 70 is positioned in the ON position such that the light switch 50 electrically connects the indicator light 60 to the utility service 30. With the light switch 50 in the ON position, the indicator light 60 will illuminate when electrical power is restored to the utility service 30. In this manner, the operator is alerted by the illuminated indicator light 60 that electrical power is restored to the utility service 30. With illumination of the indicator light 60 indicative that electrical power is restored at the utility service 30, the operator moves the transfer switch 45 so as to interrupt electrical connection to the generator 35. Continued movement of the interlock member 75 electrically connects the electrical panel 25 to receive electrical power from the utility service 30. The interlock member 75 ensures that the light switch handle 70 of the light switch 50 is moved to the OFF position simultaneously with movement of the transfer switch 45 to electronically connect the electrical panel 25 to receive electrical power from the utility service 30. With the light switch 50 in the OFF position, electrical connection to the indicator light 60 is interrupted so that the indicator light 60 is no longer illuminated.

While the invention has been shown and described with respect to a particular embodiment, it is understood that alternatives and modifications are possible and are contemplated as being within the scope of the present invention. For example, and without limitation, the switch assembly 20 may be used in connection with a wide variety of electrical panels or load centers, and is not limited to the particular type and configuration of electrical panel 25 as shown and described. In addition, the particular configuration of the interlock member 75 may vary from the configuration as shown and described. The interlock member 75 may be secured to the transfer switch 45 and the light switch 50 in any satisfactory manner that establishes a rigid connection between the switches 45 and 50. Although the switches 45 and 50 are shown aligned closely adjacent to each other as shown and described, the switches 45 and 50 may alternatively be in an offset arrangement or in any other relationship.

Various alternatives and embodiments are contemplated as being within the scope of the following claims particularly pointing out and distinctly claiming the subject matter regarded as the invention.

I claim:

1. A switch assembly for an electrical panel to selectively receive electrical power from one of a first power supply and a second power supply, comprising:

a transfer switch mounted on the electrical panel and operable to electrically connect the electrical panel to receive electrical power from the second electrical power supply when electrical power is interrupted from first power supply;

an indicator light mounted on the electrical panel and operable to illuminate with electrical power from the first electrical power supply while the transfer switch is positioned to receive electrical power from the second electrical power supply;

a light switch mounted on the electrical panel and operable to selectively interrupt electrical connection of the indicator light to the first power supply; and an interlock member that interconnects the light switch and the transfer switch, wherein movement of the interlock member so as to electrically connect the electrical panel to receive electrical power from the first power supply simultaneously moves the light switch to a position that interrupts illumination of the indicator light.

2. The switch assembly of claim 1, wherein the interlock member comprises an elongated member that defines a channel to receive both a light switch handle of the light switch and a transfer switch handle of the transfer switch.

3. The switch assembly of claim 2, wherein the channel extends throughout the length of the interlock member.

4. The switch assembly of claim 2, wherein an exterior surface of the interlock member is generally curvilinear shaped.

5. The switch assembly of claim 2, wherein the interlock member includes an opening extending therethrough configured to receive a fastener to affix the light switch handle inside the channel of the interlock member.

6. The switch assembly of claim 2, wherein the interlock member includes an opening extending therethrough configured to receive a fastener to affix the transfer switch handle inside the channel of the interlock member.

7. An electrical panel operable to receive electrical power from a first power supply and a second power supply, comprising:

a transfer switch having a transfer switch handle and operable to selectively connect the electrical panel to receive electrical power from one of a first power supply and a second power supply;

an indicator light interconnected with the electrical panel, wherein the indicator light is electrically connected to be illuminated by electrical power from the first power supply when the transfer switch is positioned to electrically connect the electrical panel to receive electrical power from the second power supply;

a light switch having a light switch handle, wherein the light switch is electrically connected to selectively interrupt illumination of the indicator light; and an interlock member that interconnects the light switch handle and the transfer switch handle, wherein, when electrical power from the first power supply illuminates the indicator light, movement of the transfer switch handle so as to cause electrical connection of the electrical panel to receive electrical power from the first power supply also simultaneously causes movement of the light switch handle via the interlock member, which interrupts electrical connection of the indicator light to the first power supply and illumination of the indicator light.

8. The electrical panel of claim 7, wherein the interlock member comprises an elongated member that defines a channel configured to receive both the light switch handle and the transfer switch handle.

9. The electrical panel of claim 8, wherein the channel extends throughout the length of the interlock member.

10. The electrical panel of claim 8, wherein an exterior surface of the interlock member is generally curvilinear shaped.

11. The electrical panel of claim 8, wherein the interlock member includes an opening extending therethrough configured to receive a fastener for affixing the light switch handle inside the channel of the interlock member.

12. The electrical panel of claim 8, wherein the interlock member includes an opening extending therethrough configured to receive a fastener for affixing the transfer switch handle inside the channel of the interlock member.

13. The electrical panel of claim of claim 7, wherein the transfer switch is movable to an OFF position to interrupt electrical connection of the electrical panel to both the first and second electrical power supplies.

14. A method of operating a transfer switch and a light switch, wherein the transfer switch is movable between a first position to electrically connect an electrical panel to receive electrical power from a first power supply and a second position to electrically connect the electrical panel to receive electrical power from a second power supply, and wherein the light switch is connected to selectively interrupt illumination of a light indicator indicative of electrical power from the first power supply while the transfer switch is in the second position to receive electrical power from the second power supply, comprising the acts of:

engaging an interlock member with the transfer switch and the light switch; and moving the light switch via the interlock member in response to movement of the transfer switch, so as to interrupt electrical connection of the indicator light to the first power supply simultaneously with moving the transfer switch to the first position to electrically connect the electrical panel to receive electrical power from the first power supply.

15. The method of claim 14, wherein the act of engaging the interlock member includes:

receiving a light switch handle of the light switch and a transfer switch handle of the transfer switch in a channel defined by the interlock member; and fastening the interlock member to the light switch handle and the transfer switch handle.

* * * * *